US007592529B2

(12) United States Patent
Tamura

(10) Patent No.: US 7,592,529 B2
(45) Date of Patent: Sep. 22, 2009

(54) STRINGED MUSICAL INSTRUMENT AND STRUCTURE OF TAILPIECE UNIT USED THEREIN

(75) Inventor: Shinya Tamura, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 12/335,709

(22) Filed: Dec. 16, 2008

(65) Prior Publication Data

US 2009/0173208 A1 Jul. 9, 2009

(30) Foreign Application Priority Data

Jan. 9, 2008 (JP) ..... 2008-002224

(51) Int. Cl.
*G10D 3/04* (2006.01)

(52) U.S. Cl. ..... 84/309

(58) Field of Classification Search ..... 84/267, 84/299, 300–302, 290, 309
See application file for complete search history.

(56) References Cited

U.S. PATENT DOCUMENTS 2,824,478 A * 2/1958 Shultz ..... 84/267

FOREIGN PATENT DOCUMENTS

JP 2000-259149 9/2000

* cited by examiner

*Primary Examiner*—Kimberly R Lockett
(74) *Attorney, Agent, or Firm*—Dickstein Shapiro LLP

(57) ABSTRACT

An electric violin has strings stretched over an instrument body, and the strings are anchored to a tailpiece, which in turn is connected to a tail wire to the instrument body; a saddle plate is bolted to the instrument body, and the tail wire is connected to the saddle plate by means of bolts; and the electric violin further has a blindfold extending from a chin-rest, and the blindfold prevents the tail wire, saddle plate and bolts from eyes of users so that the electric violin does not give the antique impression of acoustic violin to the users without sacrifice of durability of the connection between the tail wire and the instrument body.

20 Claims, 16 Drawing Sheets

STRINGED MUSICAL INSTRUMENT AND STRUCTURE OF TAILPIECE UNIT USED THEREIN

FIELD OF THE INVENTION

This invention relates to a stringed musical instrument and, more particularly, to a stringed musical instrument equipped with a tailpiece unit for anchoring strings to the instrument body and the structure of tailpiece unit.

DESCRIPTION OF THE RELATED ART

Acoustic violins, acoustic violas, acoustic cellos and acoustic contrabasses are categorized in a rubbed stringed musical instrument, and players rub the rubbed stringed musical instrument with bows so as to give rise to the vibrations of the strings. The strings are usually anchored at the ends thereof to the instrument body by means of a tailpiece, and the player tunes the rubbed musical instrument by varying the tension of strings through the tailpiece. A typical example of the tailpiece is disclosed in Japan Patent Application laid-open No. 2000-259149.

Electric violins, electric violas, electric cellos and electric contrabasses are also categorized in the rubbed stringed musical instrument, and the tailpieces are also used in the electric rubbed stringed musical instruments for the strings.

A typical example of the acoustic violin is illustrated in FIGS. 1 and 2. The prior art acoustic violin is designated in its entity by reference numeral 1, and includes an instrument body 2, a fingerboard 3 and a peg box 5. The instrument body 2 is made of wood. The instrument body 2 is constricted at an intermediate portion thereof, and a hollow space, which serves as a resonator, is formed in the instrument body 2. The instrument body 2 is symmetrical with respect to a centerline thereof. An upper surface of the instrument body 2 is defined by a sound board 6, and sound holes, which have an f-letter configuration, are formed in the sound board 6 like a mirror image with respect to the centerline. The resonator is open to the outside of the instrument body 2 through the sound holes.

The fingerboard 3 is secured to one end portion of the instrument body 2. The fingerboard 3 partially extends over the one end portion of instrument body 2, and projects from the instrument body 2 in a direction parallel to the centerline. The peg box 5 is fitted to the leading end of fingerboard 3.

The prior art acoustic violin further includes strings 4*a*, 4*b*, 4*c* and 4*d*, which are designated its entity by reference numeral 4, pegs 5*a*, 5*b*, 5*c* and 5*d*, which are designated its entity by reference numeral 4, a tailpiece 7, a nut 8, a bridge 9, a tail wire 11, a wood block (not shown) and an end pin 10. The pegs 5*a*, 5*b*, 5*c* and 5*d* and end pin 10 are made of wood. The pegs 5*a*, 5*b*, 5*c* and 5*d* are rotatably supported by the peg box 5, and project from both sides of peg box 5. The nut 8 is secured to the upper surface of leading end portion of fingerboard 3, and has an upper surface spaced from the upper surface of fingerboard 3.

The tailpiece 7 is connected to a tail wire 11, and the tail wire 11 is anchored to the other end 2*a* of instrument body 2 by means of the end pin 10. The end pin 10 is made of wood, and is tapered. The wood block (not shown) is provided inside the instrument body 2, and is adhered to the rib of instrument body 2. A hole is formed in the rib and wood block, and is tapered. The end pin 10 is inserted into the tapered hole, and the wood block (not shown) keeps the end pin 10 unmoved in the hole by virtue of the wedge effect.

The tail wire 11 keeps the tailpiece 7 spaced from the upper surface of instrument body 2. The bridge 9 stands on the sound board 6, and has the upper surface spaced from the upper surface of instrument body 2 wider than the tailpiece 7.

The strings 4*a*, 4*b*, 4*c* and 4*d* are respectively wound on the pegs 5*a*, 5*b*, 5*c* and 5*d*, and stretched over the bridge 9. The other ends of strings 4*a*, 4*b*, 4*c* and 4*d* are anchored to the tailpiece 7. The nut 8, bridge 9 and tailpiece 7 keep the strings 4 spaced from the upper surface of fingerboard 3 and the upper surface of instrument body 2.

The tail wire 11 is overlapped with the tailpiece 7, and is bolted to the tailpiece 7. The distance between the bridge 9 and the tailpiece 7 is regulable. When a player wishes to change the distance between the bridge 9 and the tailpiece 9, he or she disassembles the tailpiece 7 and tail wire 11 from the instrument body 2, and changes the length of tail wire 11 overlapped with the tailpiece 7. The distance between the tailpiece 7 and the bridge 9 is a sixth of the distance between the nut 8 and the bridge 9.

The prior art acoustic violin 1 further includes a chinrest 12. The chinrest 12 is attached to the instrument body 2, and a part of the tailpiece is overlapped with the chinrest 12. However, the end pin 10 and a part of the tail wire 11 are seen without coverage.

While a player is bowing on the strings 4 between the fingerboard 3 and the bridge 9, the strings 4*a*, 4*b*, 4*c* and 4*d* selectively vibrate, and the vibrations are propagated from the vibrating strings 4*a*, 4*b*, 4*c* and 4*d* through the bridge 9 to the sound board 6. The sound board 6 vibrates. The vibrations of sound board 6 are enlarged through the resonator, and are converted to sound waves.

As described hereinbefore, there are the electric rubbed stringed musical instruments. A typical example of electric violin is illustrated in FIGS. 3 and 4. The prior art electric violin is designated in its entity by reference numeral 20. The prior art electric violin 20 includes a body framework 2A, a fingerboard 3A and a peg box 5A. The body framework 2A has a center stem 22 and a side frame 24. However, any resonator is not formed in the body framework 2A. The side frame 24 has an outline like a half of the instrument body 2 of the acoustic violin 1, and projects from the center stem 22 in a sideward direction. In this instance, the side frame 24 is made of synthetic resin, and the center stem 22 is made of wood.

The center stem 22 is partially overlapped with the fingerboard 3A, and the fingerboard 3A projects from the center stem 22. The peg box 5A is secured to the leading end of the fingerboard 3A.

The prior art electric violin 20 further includes strings 4A, pegs 5*e*, a nut 8A, a bridge 9A, a pickup PKA and a tailpiece 21. The nut 8A is partially embedded in the leading end portion of fingerboard 3A, and the upper surface of nut 8A is spaced from the upper surface of fingerboard 3A. The bridge 9A stands on the upper surface of center stem 22, and the pickup PKA is provided between the center stem 22 and the bridge 9A. The tailpiece is provided on the upper surface of center stem 22, and is secured to the center stem 22 by means of bolts (not shown). The bolts (not shown) pass through the center stem 22, and are driven into the tailpiece 21. For this reason, the tailpiece 21 is not moved. The strings 4A are respectively wound on the pegs 5*e*, and are stretched over the bridge 9A. The strings 4A are anchored to the tailpiece 21.

The prior art electric violin 20 further includes a chinrest 12A, and the chinrest 12A is secured to the center stem 22. Any part of the tailpiece 21 is not overlapped with the chinrest 12A so that the entire tailpiece 21 is exposed to a player.

While a player is bowing the strings 4A between the fingerboard 3A and the bridge 9A, the strings 4A vibrate, and the vibrations are propagated from the strings 4A through the bridge 9A to the pickup PKA. The vibrations are converted to an electric signal through the pickup PKA, and the electric signal is supplied to a sound system (not shown).

Turning to FIGS. 5 and 6, a mute electric violin is designated in its entity by reference numeral 30. The prior art mute electric violin 30 includes a body framework 2B, a fingerboard 3B and a peg box 5B. The body framework 2B has a center stem 22B and a side frame 24B. However, any resonator is not formed in the body framework 2B. The side frame 24B has an outline like a half of the instrument body 2 of the acoustic violin 1, and projects from the center stem 22B in a sideward direction.

The center stem 22B is partially overlapped with the fingerboard 3B, and the fingerboard 3B projects from the center stem 22B. The peg box 5B is secured to the leading end of the fingerboard 3B.

The prior art mute electric violin 30 further includes strings 4B, pegs 5*f*, a nut 8B, a bridge 9B, a pickup PKB, a wood block 23 and a tailpiece 7B. The nut 8B is partially embedded in the leading end portion of fingerboard 3B, and the upper surface of nut 8B is spaced from the upper surface of fingerboard 3B. The bridge 9B stands on the upper surface of center stem 22B, and the pickup PKB is provided between the center stem 22B and the bridge 9B.

The tailpiece 7B is provided over the upper surface of center stem 22, and is connected to a tail wire 11B. The end pin 10B is tapered, and a hole and a tapered hole are formed in the end portion of side frame 24B and wood block 24B, respectively. The tail wire 11B is anchored to the end pin 10B, and the end pin 10B is inserted through the hole into the tapered hole of wood block 32. The wedge effect keeps the end pin 10B in the tapered hole.

The strings 4A are respectively wound on the pegs 5*f*, and are stretched over the bridge 9B. The strings 4B are anchored to the tailpiece 7B.

The prior art electric violin 20 further includes a chinrest 12B, and the chinrest 12B is secured to the center stem 22B. The tailpiece 21 is partially overlapped with the chinrest 12B. However, the end pin 10B and tail wire 11B are seen without any coverage.

A problem is encountered in the prior art acoustic violin 1 in that the end pin 10 is liable to be unintentionally dropped off from the wood block due to aged deterioration and variation in temperature and humidity. In detail, the end pin 10 and wood block (not shown) are made of wood, and the friction between the tapered surfaces remains the end pin 10 in the wood block (not shown). However, the tapered surfaces are hardened during long time. Moreover, the end pin 10 and wood block (not shown) are repeatedly expanded and constricted in the variation of temperature and humidity. These phenomena make the friction reduced. As a result, the end pin 10 is unintentionally dropped off from the wood block (not shown) when the external force changes the direction during change of strings, by way of example.

The prior art electric violin 20 is free from the problem inherent in the prior art acoustic violin 1. However, the players feel the bows unfamiliar in the bowing on the strings 4A. Especially, players who are used to bowing on the acoustic violin feel it curious, and tend to hate to play on the prior art electric violin 20. This is because of the fact that the tailpiece 21 is bolted to the center stem 22. In detail, since the tail wire 11 is provided between the end pin 10 and the tailpiece 7 of the prior art acoustic violin 1, the tail wire 11 allows the tailpiece 7 to tremble during the bowing on the strings 4, and the reaction of tremble is propagated through the vibrating strings 4 and bow to player's hand. On the other hand, the tailpiece 21 is directly bolted to the center stem 22 so as to be rigid to the body framework 2A. Even if the player varies the pressure exerted on the strings 4A through the bow in the performance, the tailpiece 21 keeps the attitude on the center stem 22, and does not respond to the variation of pressure. As a result, the players feel the bows curious. Thus, the tailpiece 21 makes the prior art electric violin 20 not acceptable to the player who is used to bowing on the acoustic violin.

Another problem inherent in the prior art electric violin 20 is poor tone quality. Although the vibrations of strings 4A are converted to the electric signal by means of the pickup PKA, vibrations of the entire body framework 2A deeply concern the tone quality. The tailpiece 21 is fixed to the center stem 22 at an intermediate portion of the center stem 22 so that the vibrations of strings 4A are propagated to the intermediate portion. Since the intermediate portion is spaced from the rear end of center step 22, the entire body framework 2A does not widely vibrates. As a result, the players feel the electric tones poor in tone quality.

The prior art mute electric violin 30 is equipped with the tailpiece 7B supported by the end pin 10B through the tail wire 11B. For this reason, the prior art mute electric violin 30 is free from the curious impression in the bowing inherent in the prior art electric violin 20. However, the end pin 10B is liable to be dropped off from the wood block 32 due to the aged deterioration as similar to that of the acoustic violin 1.

Another problem is that the prior art mute electric violin 30 gives antique impression to users. The tail wire 11B and end pin 10B have been used in the acoustic violins since early times, and the mute electric violin 30 equipped them reminds users of the acoustic violins. Even if designers give a unique contour to the mute electric violin, the unique contour does not drastically change the impression on the prior art mute electric violin 30 due to the tail wire 11B and end pin 10B.

SUMMARY OF THE INVENTION

It is therefore an important object of the present invention to provide a stringed musical instrument, a tailpiece unit of which is free from an unintentional separation from an instrument body and the antique impression.

It is also an important object of the present invention to provide the tailpiece unit to be used in the stringed musical instrument.

To accomplish the object, the present invention proposes to prevent a tail wire and a fastener from eyes of users by means of a blindfold.

In accordance with one aspect of the present invention, there is provided a stringed musical instrument for producing music sound comprising an instrument body having a longitudinal direction and a lateral direction, at least one string stretched in the longitudinal direction over the instrument body, a connector connected between one end of the instrument body and one end of the aforesaid at least one string, and a tailpiece unit provided at the other end of the instrument body and including a tailpiece connected to the other end of the aforesaid at least one string, a tail wire connected at one end thereof to the tailpiece and keeping the tailpiece spaced from the instrument body, a fastener made of a certain sort of material less influenced in variation of humidity rather than wood and securing the tail wire to the instrument body and a blindfold supported by the instrument body and preventing the tail wire and the fastener from eyes of users.

In accordance with another aspect of the present invention, there is provided a tailpiece unit used for a stringed musical instrument comprising a tailpiece connected to an end of at least one string of the stringed musical instrument, a tail wire connected at one end thereof to the tailpiece and keeping the tailpiece spaced from an instrument body of the stringed musical instrument, a fastener made of a certain sort of material less influenced in variation of humidity rather than wood and securing the tail wire to the instrument body, and a blindfold supported by the instrument body and preventing the tail wire and the fastener from eyes of users.

BRIEF DESCRIPTION OF THE DRAWINGS

The features and advantages of the stringed musical instrument and tailpiece unit will be more clearly understood from the following description taken in conjunction with the accompanying drawings, in which.

DESCRIPTION OF THE PREFERRED EMBODIMENTS

A stringed musical instrument embodying the present invention is used for producing music sound, and comprises an instrument body, at least one string, a connector and a tailpiece unit. The instrument body has a longitudinal direction and a lateral direction. The connector is connected between one end of the instrument body and one end of the at least one string, and a tailpiece unit is provided at the other end of the instrument body. The at least one string is stretched in the longitudinal direction over the instrument body between the connector and the tailpiece unit.

The tailpiece unit includes a tailpiece, a tail wire, a fastener and a blindfold. The tailpiece is connected to the other end of the at least one string. The tail wire is connected at one end thereof to the tailpiece, and the fastener secures the other end of tail wire to the instrument body in such a manner that the tail wire keeps the tailpiece spaced from the instrument body. The fastener is made of a certain sort of material less influenced in variation of humidity rather than wood. The blindfold is supported by the instrument body, and prevents the tail wire and the fastener from eyes of users.

Since the tailpiece floats over the instrument body by virtue of the tail wire as similar to the tailpiece of an acoustic stringed musical instrument such as, for example, a violin, the tailpiece can tremble during bowing on the at least one string, and a player feels the bow on the at least one string same as that of the strings of acoustic stringed musical instrument.

Moreover, the fastener is more durable rather than a wood end pin and a wood block of the acoustic stringed musical instrument, because the fastener is made of a certain sort of material less influenced in variation of humidity rather than wood.

Finally, even though the tail wire is used between the tailpiece and the instrument body, users do not feel the stringed musical instrument implementing the embodiment antique, because the blindfold prevents the tail wire and fastener from the eyes of users.

In the following description, strings stretched over an instrument body extend in parallel to a "longitudinal" direction, and a "lateral direction" crosses the longitudinal direction at right angle. Term a "perpendicular" direction is normal to a plane defined by the longitudinal direction and lateral direction, and the thickness of instrument body is in parallel to the perpendicular direction.

First Embodiment

Figure 1:
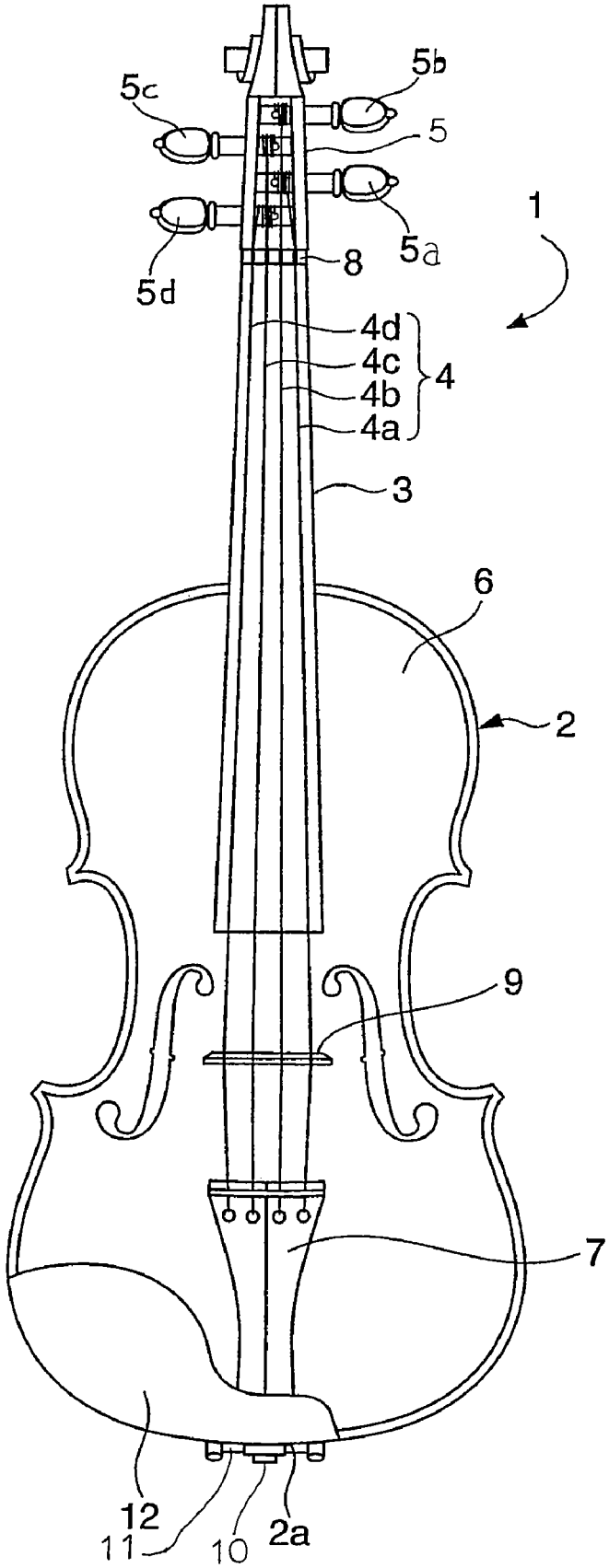
Fig. 1 Prior Art
FIG. 1 is a plane view showing the structure of the prior art acoustic violin.
Figure 2:
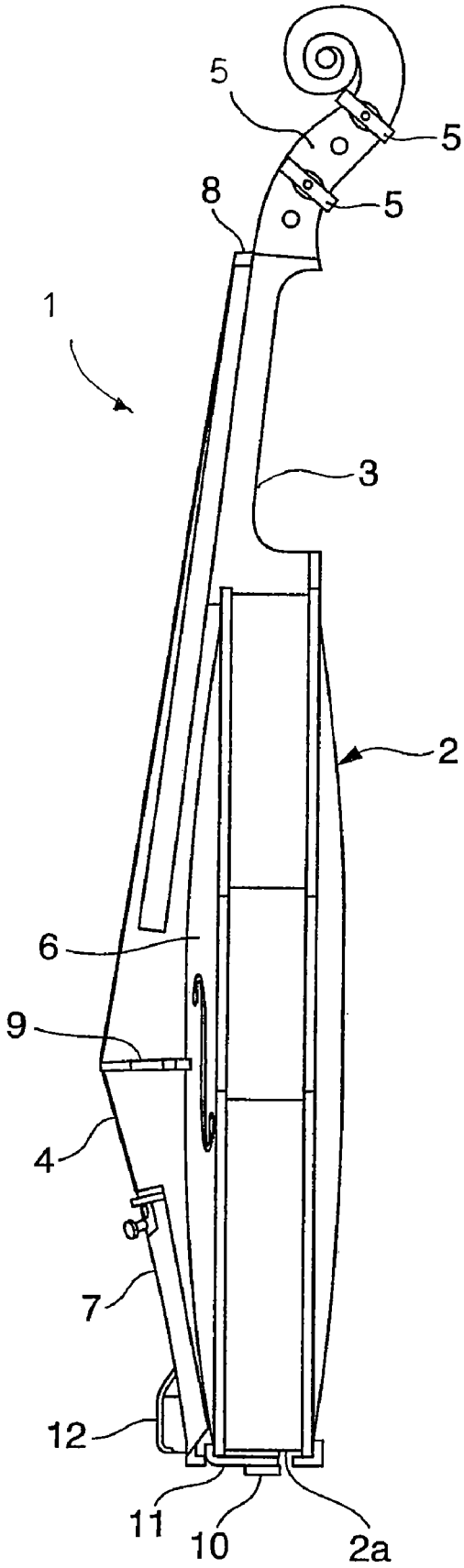
Fig. 2 Prior Art
FIG. 2 is a side view showing the structure of prior art acoustic violin.
Figure 3:
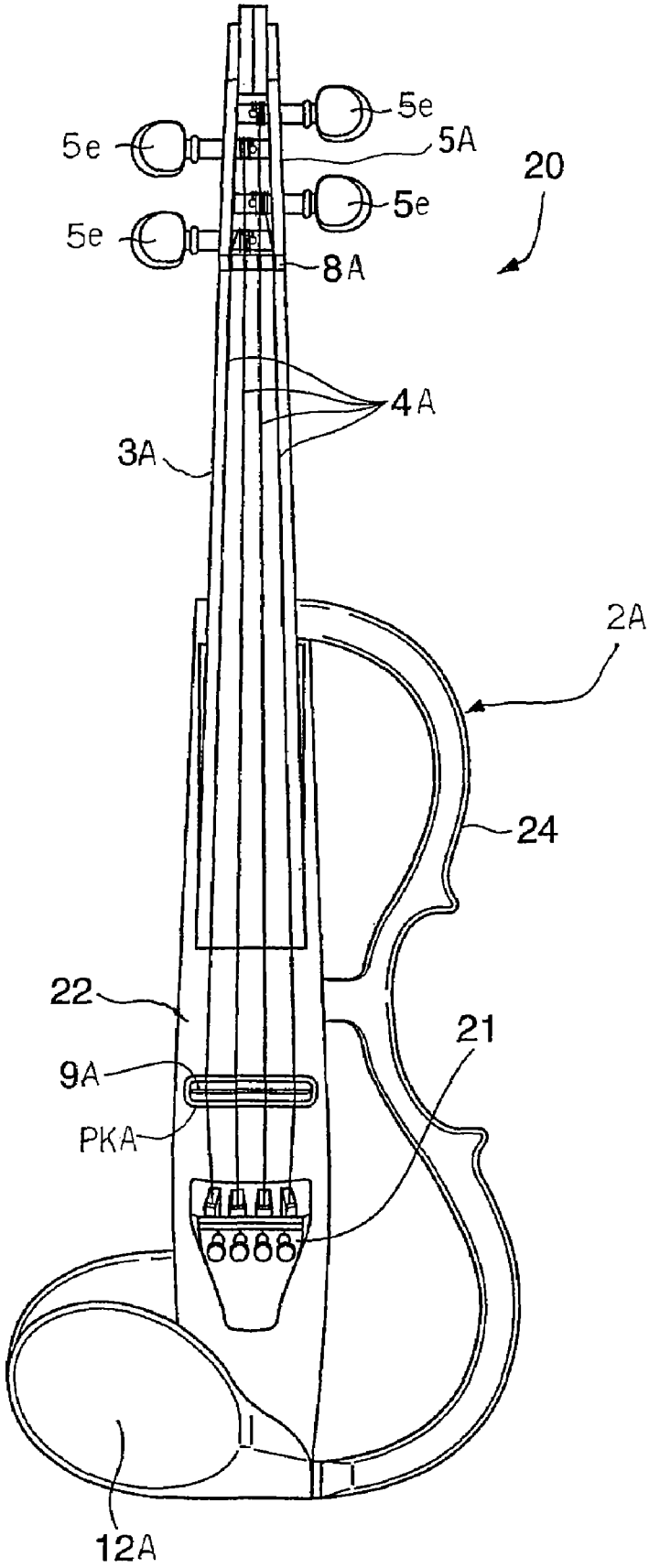
Fig. 3 Prior Art
FIG. 3 is a plane view showing the structure of the prior art electric violin.
Figure 4:
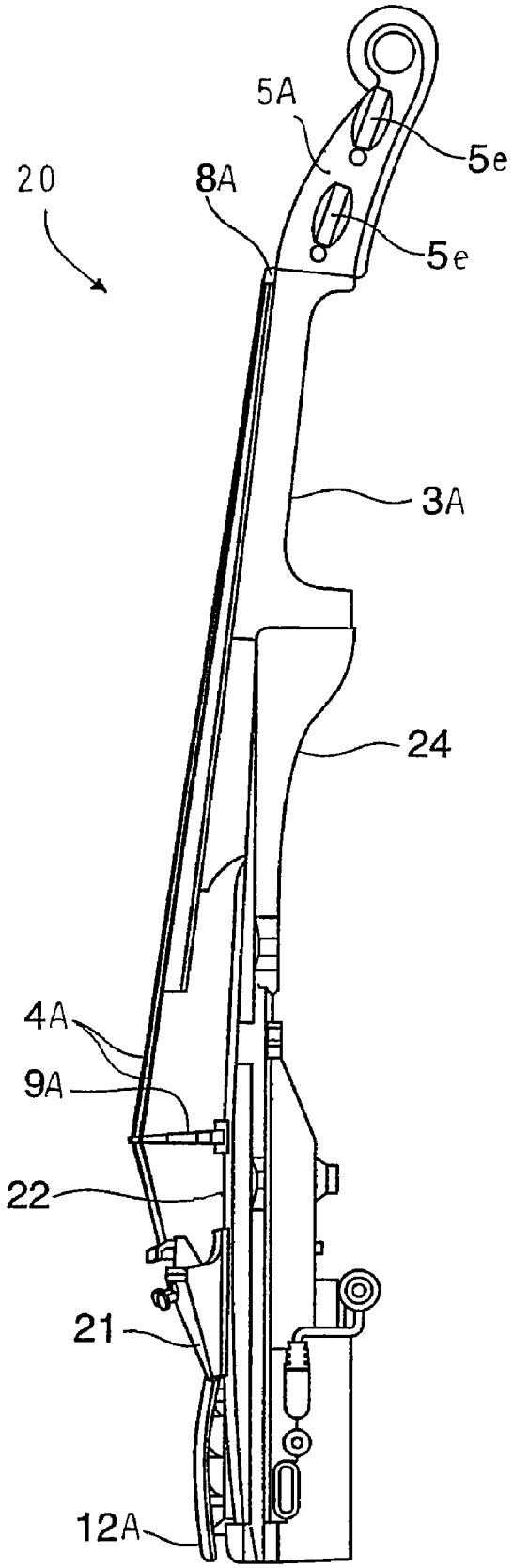
Fig. 4 Prior Art
FIG. 4 is a side view showing the structure of prior art electric violin.
Figure 5:
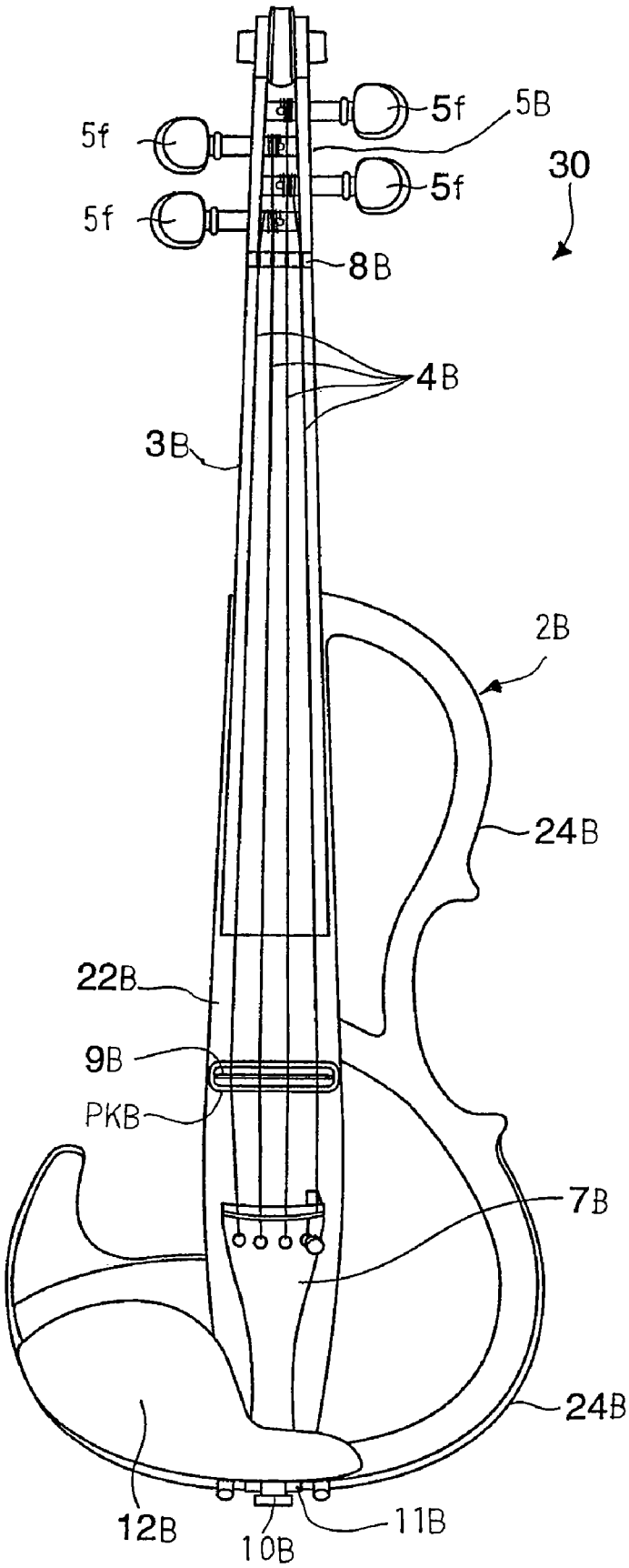
Fig. 5 Prior Art
FIG. 5 is a plane view showing the structure of the prior art mute electric violin.
Figure 6:
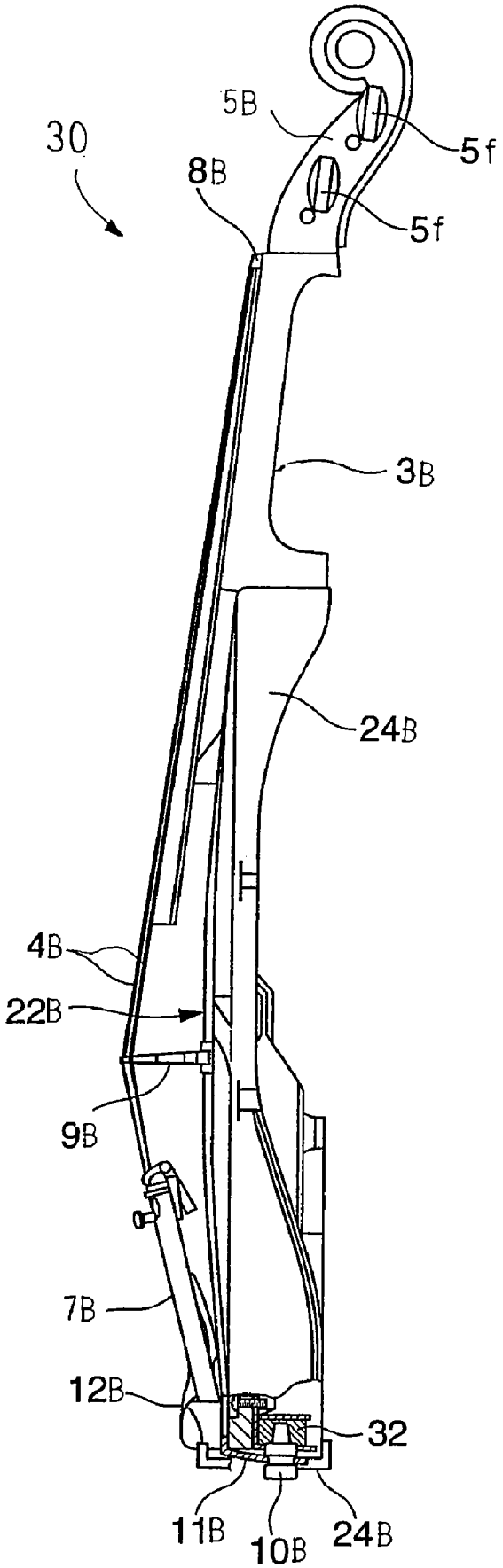
Fig. 6 Prior Art
FIG. 6 is a side view showing the structure of prior art mute electric violin.
Figure 7:
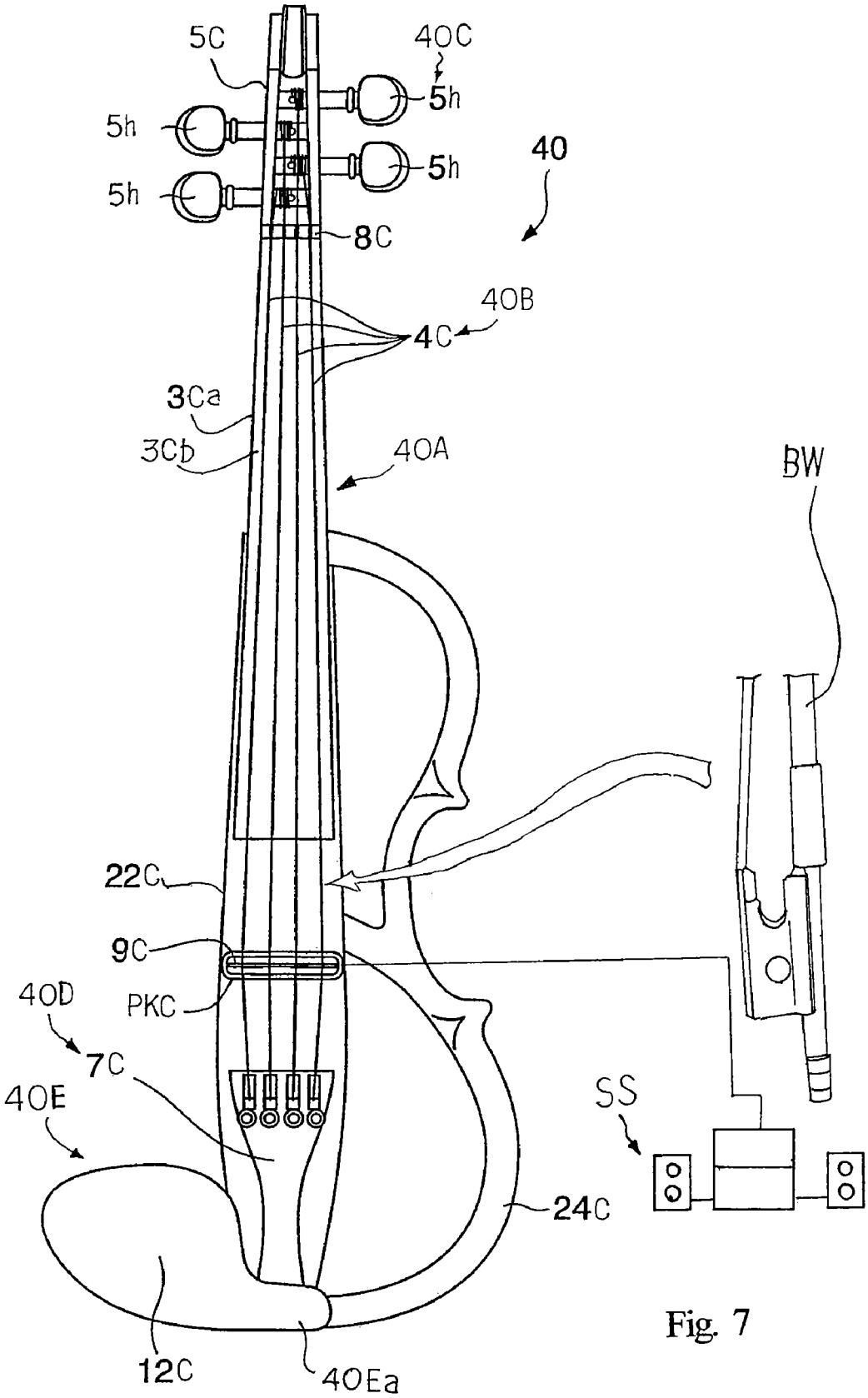
FIG. 7 is a plane view showing the structure of an electric violin of the present invention.
Figure 8:
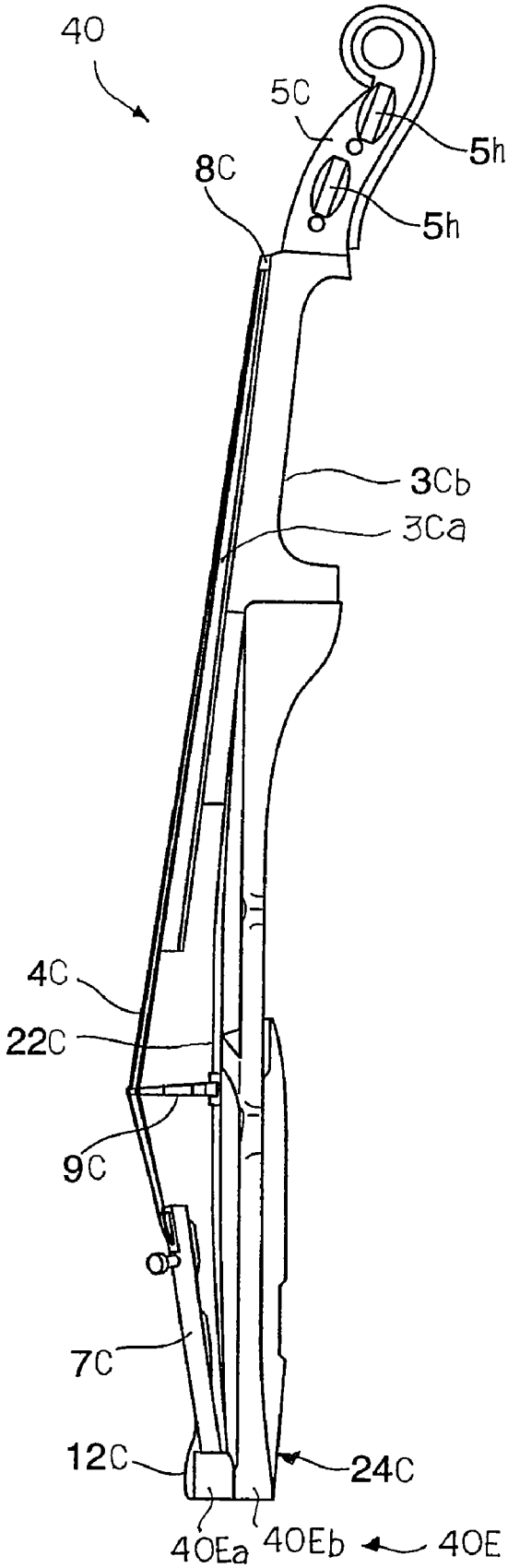
FIG. 8 is a side view showing the structure of the electric violin of the present invention.

Referring to FIGS. 7 and 8 of the drawings, an electric violin embodying the present invention is designated in its entity by reference numeral 40. The electric violin 40 largely comprises an instrument body 40A, a set of strings 40B, a stretcher 40C, an anchor 40D and a blindfold 40E. The instrument body 40A has the longitudinal direction, and the set of strings 40B extends over the instrument body 40A in parallel to the longitudinal direction. The stretcher 40C and anchor 40D are fitted to the instrument body 40A, and are spaced from each other in the longitudinal direction. The set of strings 40B is anchored at one end thereof to the instrument body 40A by means of the anchor 40D, and is connected at the other end thereof to the stretcher 40C. The stretcher 40C gives appropriate tension to the set of strings 40B. A player rubs the strings 40B with a bow BW for his or her performance.

The blindfold 40E is supported by the instrument body 40A, and the connection between the instrument body 40A and the anchor 40D is covered with the blindfold 40E. Thus, the blindfold 40E prevents the connection between the instrument body 40A and the anchor 40D from the eyes of users. Even if component parts of an acoustic stringed musical instrument form parts of the anchor 40D, the component parts are not seen by the users so that the electric violin 40 does not give the antique impression to the users.

Figure 9:
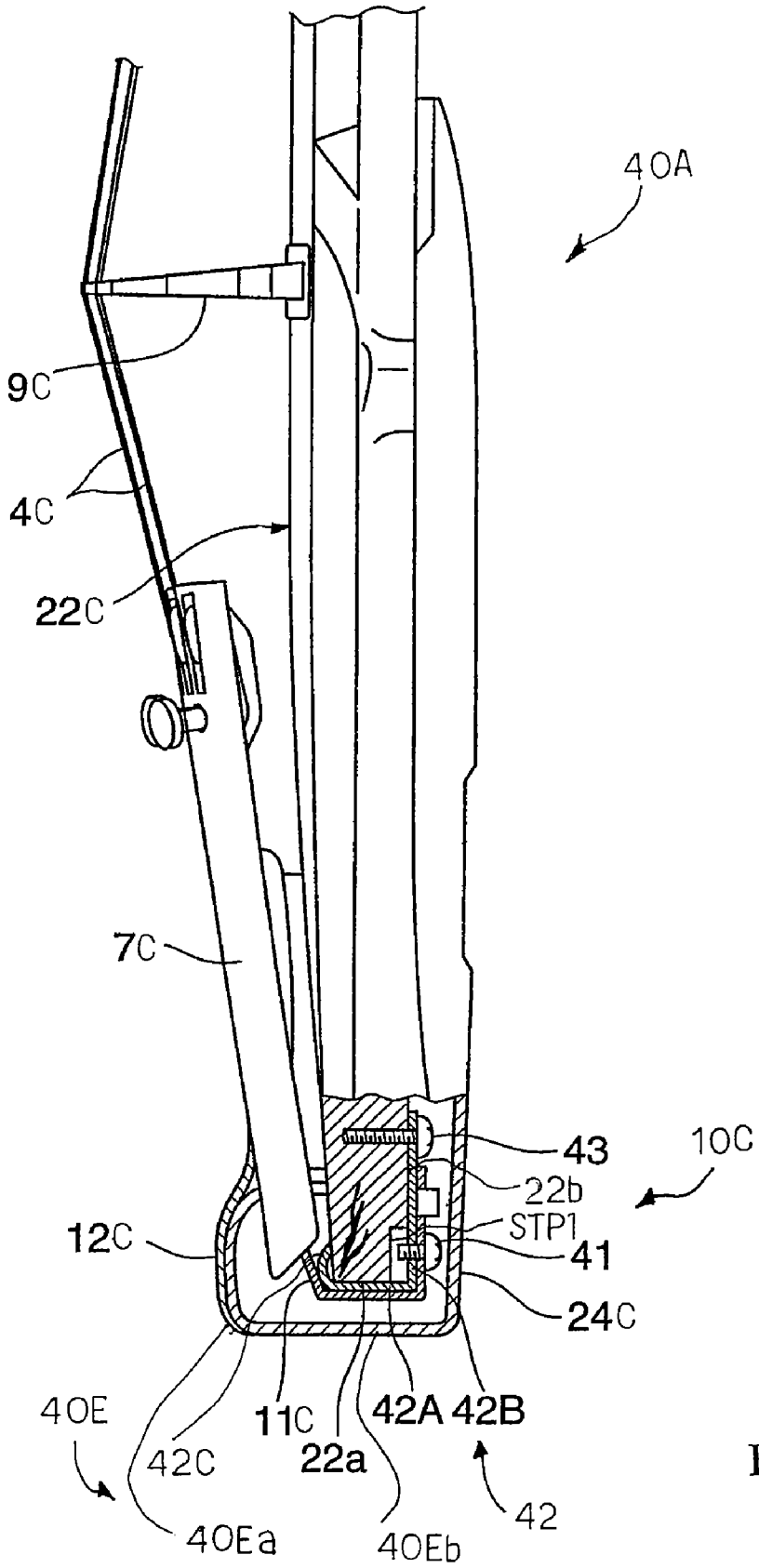
FIG. 9 is a partially cut-away side view showing a tail wire anchored to a body framework of the electric violin.

FIG. 9 is hereinafter referred to together with FIGS. 7 and 8. The instrument body 40A includes a neck 3Ca, a fingerboard 3Cb, a peg box 5C, a center stem 22C and a side frame 24C. The center stem 22C is made of wood, and has length much greater than width. The rear end portion of center stem 22C is partially cut away so that a step STP1 takes place. The neck 3Ca is secured to the front end surface of center stem 22C, and projects from the front end surface in the forward direction. A front portion of the center stem 22C is overlapped with a rear portion of the fingerboard 3Cb, and a front portion of fingerboard 3Cb is secured to the upper surface of neck 3Ca.

The peg box 5C is fixed to the leading end portion of neck 3Ca, and projects from the leading end portion of neck 3Ca. The side frame 24C is made of synthetic resin, and has a contour like half of the instrument body of an acoustic violin. The side frame 24C is connected at a front portion, intermediate portion and rear portion to the center stem 22C, and projects from the side surface of center stem 22C in a sideward direction.

The stretcher 40C includes pegs 5*h*, a nut 8C and a bridge 9C. The pegs 5*h* are rotatably supported by the peg box 5C, and project in a staggered manner from the peg box 5C in the sideward directions. The nut 8C is secured to the upper surface of neck 3Ca, and projects over the upper surface of fingerboard 3Cb. The nut 8C extends in the lateral direction. The bridge 9C is formed from a thin plate, which is usually made of wood, and stands on the upper surface of center stem 22C. The bridge 9C extends in the lateral direction, and a pickup unit PKC is inserted between the center stem 22C and the bridge 9C. Vibrations of the bridge 9C are converted to an electric signal through the bridge 9C. The electric signal in turn is converted to electric tones through a sound system SS.

The anchor 40D is secured to the rear end portion of center stem 22C, and is hereinafter described in detail. Four strings 4C form the set of strings 40B, and are different in thickness from one another. The pegs 5*h* are respectively assigned to the strings 4C, and are wound on the associated pegs 5*h*. The strings 4C extend in the longitudinal direction over the fingerboard 3Cb and center stem 22C, and are held in contact with the upper surface of nut 8C and the upper surface of bridge 9C. The nut 8C and bridge 9C keep the strings 4C spaced from the upper surface of fingerboard 3Cb and the upper surface of center stem 22C. The other end portions of strings 4C are terminated at the anchor 40D. A player rotates the pegs 5*h*, and exerts tension on the strings 4C.

The anchor 40D includes a tailpiece 7C, a tail wire 11C and a fastener 10C. The tail wire 11C is connected to the tailpiece 7C by means of bolts (not shown), by way of example. The tail wire 11C extends from the tailpiece 7C in the rearward direction, and is twice bent along the end surface and back surface of rear portion of center stem 22C as will be better seen in FIG. 9. The tail wire 11C keeps the tailpiece 7C spaced from the upper surface of center stem 22C so as to allow the tailpiece to tremble during the bowing on the strings 4C. The player feels the reaction of tremble through the strings 4C and the bow BW with his or her hand. This phenomenon is similar to that of an acoustic violin. As a result, the player feels the electric violin 40 familiar.

The tail wire 11C is secured to the rear end portion of center stem 22C by means of the fastener 10C. The fastener 10C is made of metal or alloy, and, accordingly, is stronger than wood. The tail wire 11C is separable from the rear portion of center stem 22C in the rearward direction, and the fastener 10C is separable from the rear portion of center stem 22C in the perpendicular direction through a movement different from the movement in the rearward direction. An example of the movement different from the rearward movement is rotation about the perpendicular direction. The fastener 10C fixes the tail wire 11C to the rear end portion of center stem 22C by virtue of large rigidity thereof. On the other hand, the tail wire 11C exerts the force on the fastener 10C in the rearward direction. For this reason, the fastener 10C keeps the tail wire 11C unmoved on the rear portion of center stem 22C in so far as the tail wire 11C does not break the fastener 10C.

In this instance, the fastener 10C includes a saddle plate 42 and bolts 41 and 43. The saddle plate 42 is made of metal or alloy, and a metal plate is twice bent in such a manner that the rear end portion of center stem 22C is received in the inner surface of saddle plate 42. A rear portion, a lower portion and an upper portion of saddle plate 42 are respectively labeled with 42A, 42B and 42C. The rear portion 42A and lower portion 42B have flat inner surfaces, and the upper portion 42C is rounded. An end surface of upper portion 42C is opposed to the inner surface of lower portion 42B. The end surface of upper portion 42C is held in contact with the upper surface of rear portion of center stem 22C, and the inner surface of rear portion 42A and the inner surface of lower portion 42B are respectively held in contact with the rear end surface 22*a* and lower surface 22*b* of rear end portion of center stem 22C. As described hereinbefore, the rear portion of center stem 22C is partially cut away so that a hollow space is defined between the step STP1 and the inner surface of the saddle plate 42.

The bolts 43 and 41 are made of metal or alloy such as, for example, steel, stainless steel or copper alloy. The saddle plate 42 is formed with front bolt holes, and the lower surface of rear portion of center stem 22C is held in contact with the inner peripheries of front bolt holes. The bolts 43 are driven into the rear portion of center stem 22C through the front bolt holes. As a result, the saddle plate 42 is fixed to the rear portion of center stem 22C. It is rare to separate the saddle plate 42 from the center stem 22C. For this reason, the female screws of wooden center stem 22C do not crumble. Thus, the saddle plate 42 is strongly fixed to the rear portion of center stem 22C for a long service time period.

The rear bolt holes are threaded. The rear bolt holes are located at the step STP1 so that the hollow space is exposed to the outside through the rear bolt holes. The tail wire 11C extends along the saddle plate 42, and is held in contact with the rounded upper portion 42*c*, flat rear portion 42A and flat lower portion 42B. The tail wire passes in the vicinity of rear bolt holes, and is connected to the saddle plate 42 by means of the bolts 41. The bolts 41 pass through the rear bolt holes. However, the tips of bolts 41 do not reach the step STP1. Thus, the tail wire 11C is guided through the upper and rear portions 42C and 42A to the lower portion 42B, and is secured to the lower portion 42B by means of the bolts 41.

The tailpiece 7C, tail wire 11C and saddle plate 42 are provided between the strings 4C and the center stem 22C, and the saddle plate 42 is widely spaced from the pickup PKC. Even if the vibrations of strings 4C reach the pickup PKC through the center stem 22C, the vibrations do not have serious influence on the vibrations propagated through the bridge 9C. As a result, the vibrations of strings 4C are converted to the electric signal at high fidelity.

When the strings 4C are stretched, the tension is exerted on the tail wire 11C through the tailpiece 7C, and the sharing force is exerted on the bolts 41. The bolts 41 and 43 are so strong that the stretched strings 4C can not break the bolts 41 and 43.

Although players occasionally separate the tail wire 11C from the saddle plate 42, the threaded rear bolt holes hardly crumble. Even if the player frequently looses and tightens the bolts 41, the bolts 41 keep the threaded engagement with the saddle plate 42 for the long service time period. The change in temperature and humidity is less influential in the threaded engagement between the saddle plate 42 and the bolts 41 and 43. Thus, the fastener 10C is more durable than the prior art fastener, i.e., the combination of wood block 32 and end pin 10B.

In order to loose the bolts 41, torque is to be exerted on the bolts 41 about the center axes of bolts 41. However, the tension of stretched strings 4C is received by the stems of bolts 41. The tension does not give rise to the torque, or a quite small amount of torque. For this reason, the bolts 41 are not unintentionally loosened. In other words, the tailpiece 7C is not unintentionally dropped off from the instrument body 40A.

The electric violin 40 further comprises a chinrest 12C, and the chinrest 12C is connected to the center stem 22C. The blindfold 40E is partially implemented by an extension 40Ea of the chinrest 12C, and is further partially implemented by an extension 40Eb of the side frame 24C. Thus, the blindfold 40E does not increase the number of component parts of the electric violin 40.

The rear portion of tailpiece 7C is covered with the extension 40Ea, and the tail wire 11C, saddle plate 42 and bolts 41 and 43 are covered with the extension 40Eb as will be better seen in FIG. 8. The tail wire 11C, saddle plate 42 and bolts 41 and 42 are not seen from any rear position, any side position, any upper position and any lower position with respect to the instrument body 40A. As a result, electric violin 40 does not give the antique impression to users. Designers are free from the impression of the tail wire 11C, and can give various modern contours to electric violins of the present invention.

As will be understood from the foregoing description, the tailpiece 7C is supported over the center stem 22C by the tail wire 11C, and the tail wire 11C, saddle plate 42 and bolts 41 and 43 are covered with the blindfold 40E. As a result, users are free from the antique impression.

The saddle plate 42 is secured to the rear end of center stem 22C so that the vibrations of strings 40B is propagated to the rear end of center stem 22C. As a result, the vibrations of strings 40B are well spread to the entire center stem 22C. This results in improvement of tone quality.

Finally, the tail wire 11C makes the tailpiece 7C tremble during the bowing on the strings 4C as similar to that of the acoustic violins. The impression on the player is close to that given from the bowing on the acoustic violin. For this reason, the electric violin of the present invention is acceptable to the players who are used to bowing on the acoustic violins.

Second Embodiment

Figure 10:
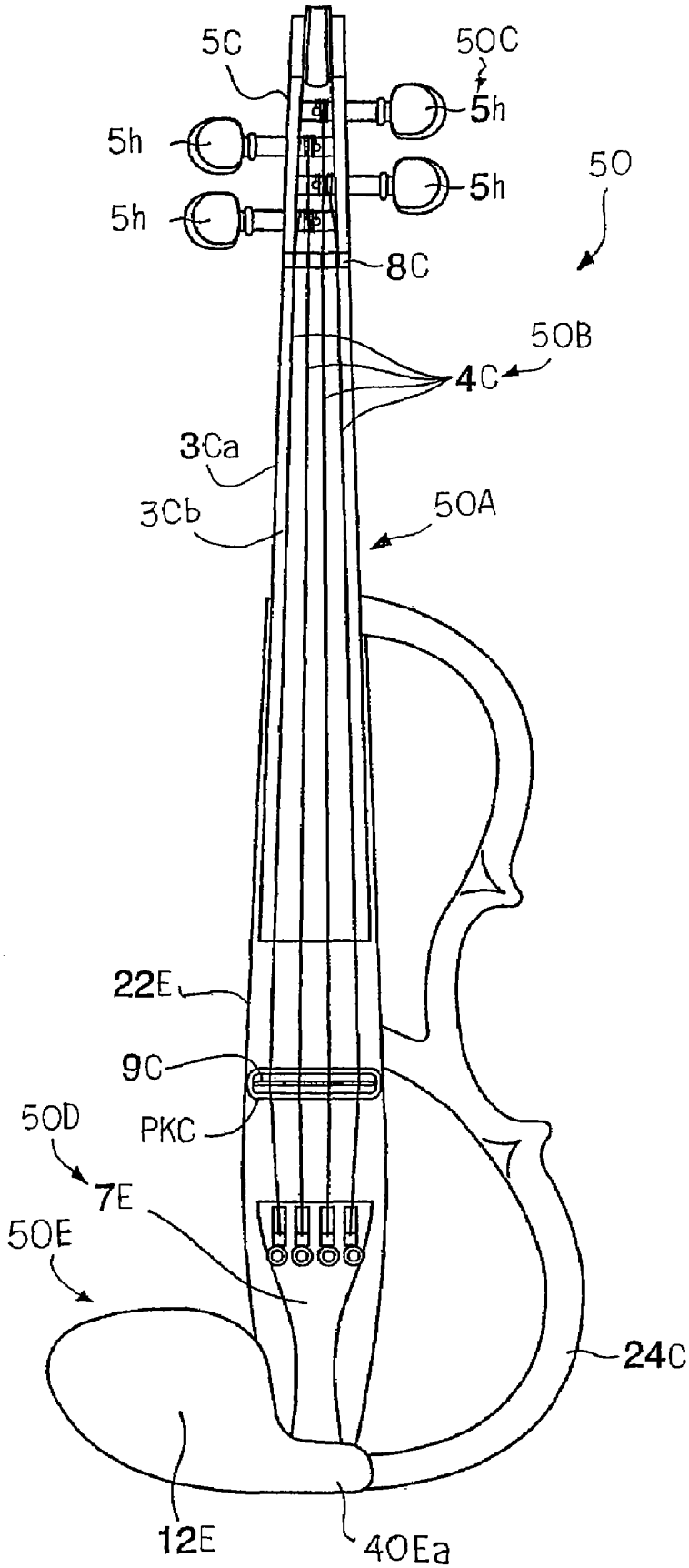
FIG. 10 is a plane view showing the structure of another electric violin of the present invention.
Figure 11:
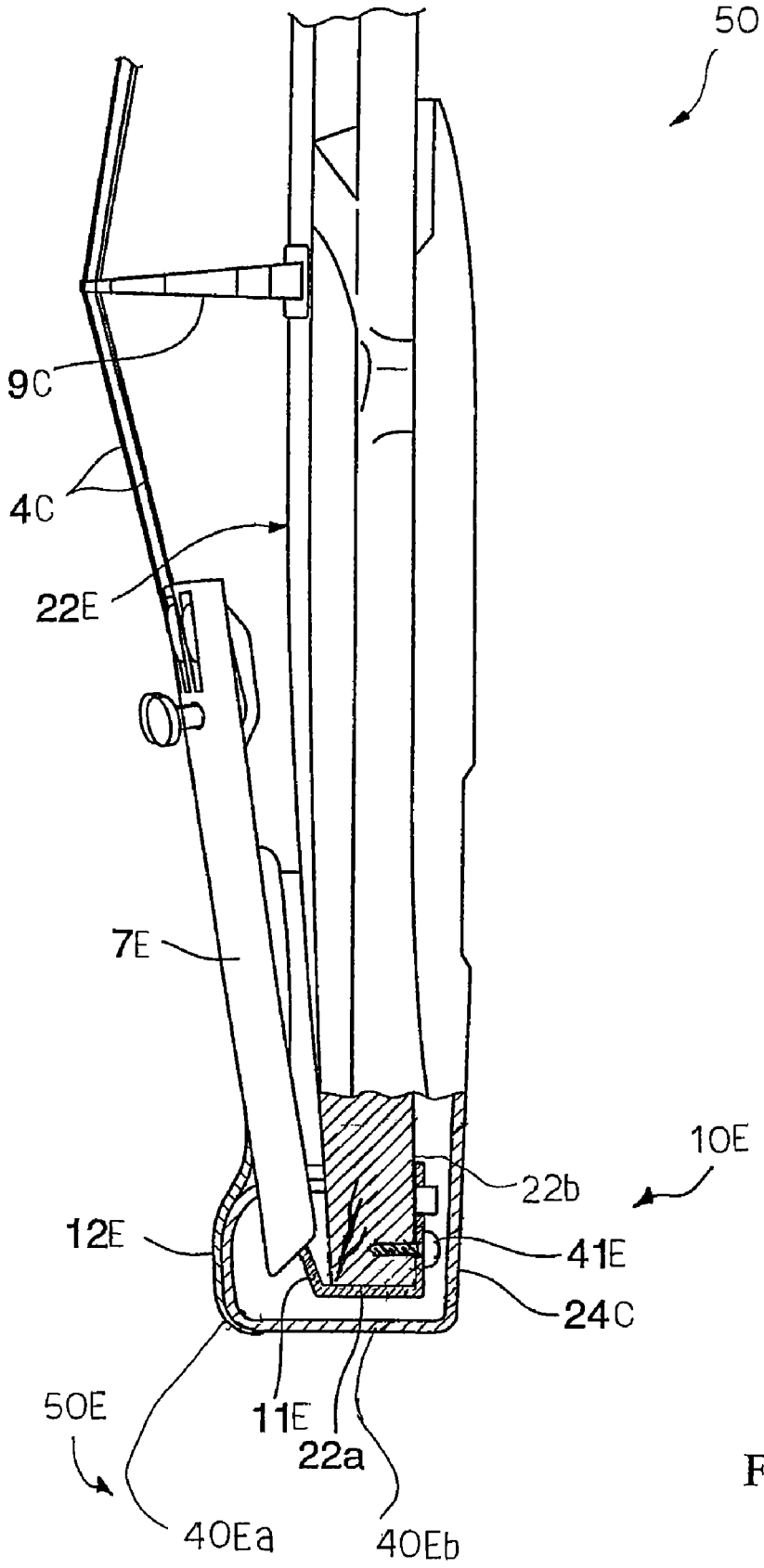
FIG. 11 is a partially cut-away side view showing a tail wire anchored to a body framework of the electric violin.

Turning to FIGS. 10 and 11 of the drawings, another electric violin embodying the present invention is designated in its entirety by reference numeral 50. The electric violin 50 largely comprises an instrument body 50A, a set of strings 50B, a stretcher 50C, an anchor 50D, a blindfold 50E and a chinrest 12E. The instrument body 50A, set of strings 50B, stretcher 50C, blindfold 50E and chinrest 12E are similar to the instrument body 40A, set of strings 40B, stretcher 40C, blindfold 40E and chinrest 12C, respectively, except for the rear portion of center stem, and, for this reason, the other component parts are labeled with references designating the corresponding component parts shown in FIGS. 7 to 9 without detailed description. A difference between the center stem 22C and the center stem 22E is that any step is not formed in the rear portion of center step 22E.

The anchor 50D includes a tailpiece 7E, a tail wire 11E and a fastener 10E. The tailpiece 7E and tail wire 11E are similar to the tailpiece 7C and tail wire 11C, and, for this reason, no further description is hereinafter incorporated for the sake of simplicity.

The fastener 10E is implemented by bolts 41E. The saddle plate 42 is not incorporated in the fastener 10E. The tail wire 11E is directly bolted to the rear portion of center stem 22E. The rear portion of tailpiece 7E is converted with the extension 40Ea of blindfold 50E, and the tail wire 11E and bolts 41E are covered with the extension 40Eb of blindfold 50E.

The tail wire 11E permits the tailpiece 7E to tremble, and the player feels the bowing on strings 4C similar to that on the strings of an acoustic violin. Moreover, the tail wire 11E is connected to the rear portion of center stem 22E so that the player gives rise to the vibrations of enter center stem 22E. This results in improvement of tone quality.

Third Embodiment

Figure 12:
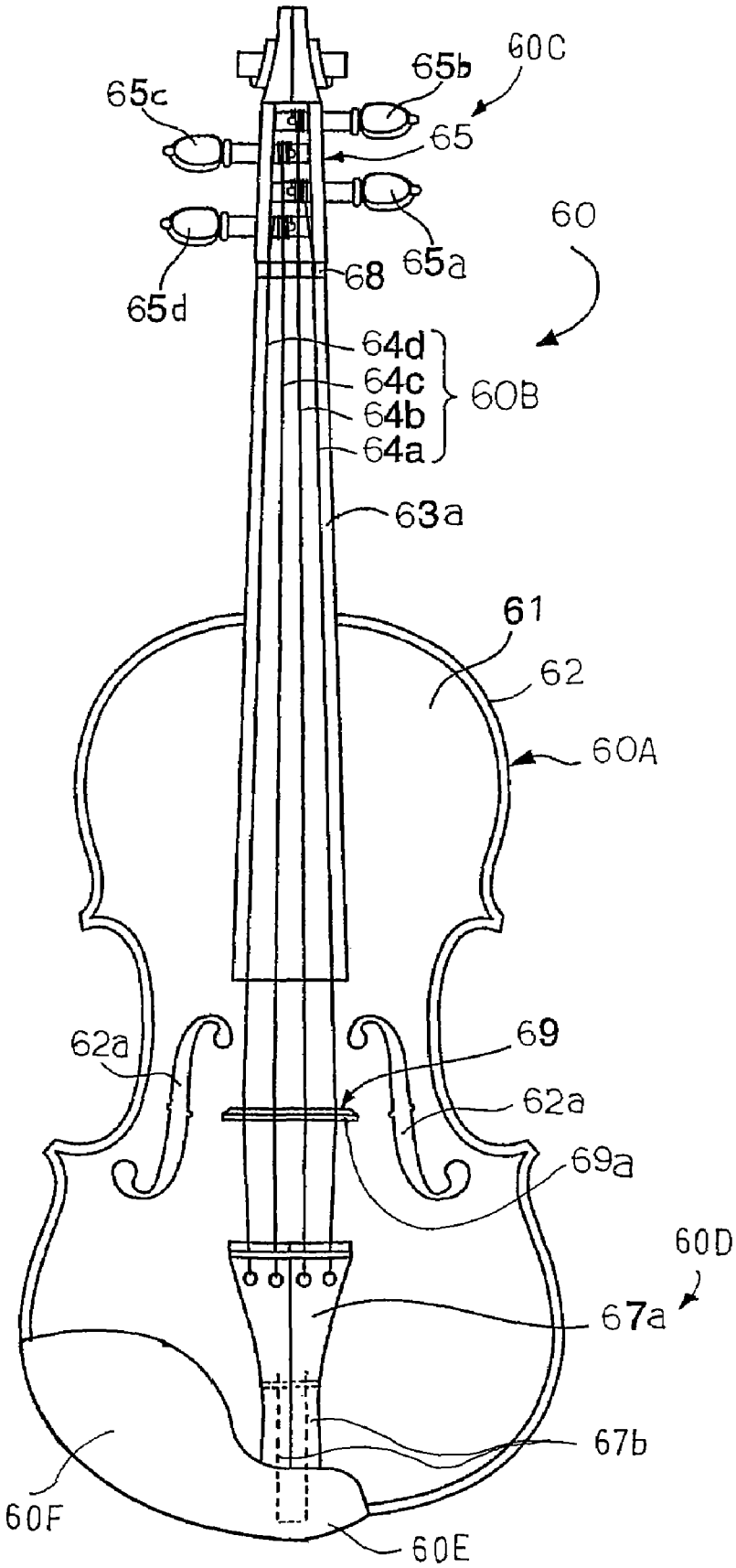
FIG. 12 is a plane view showing the structure of an acoustic violin of the present invention.
Figure 13:
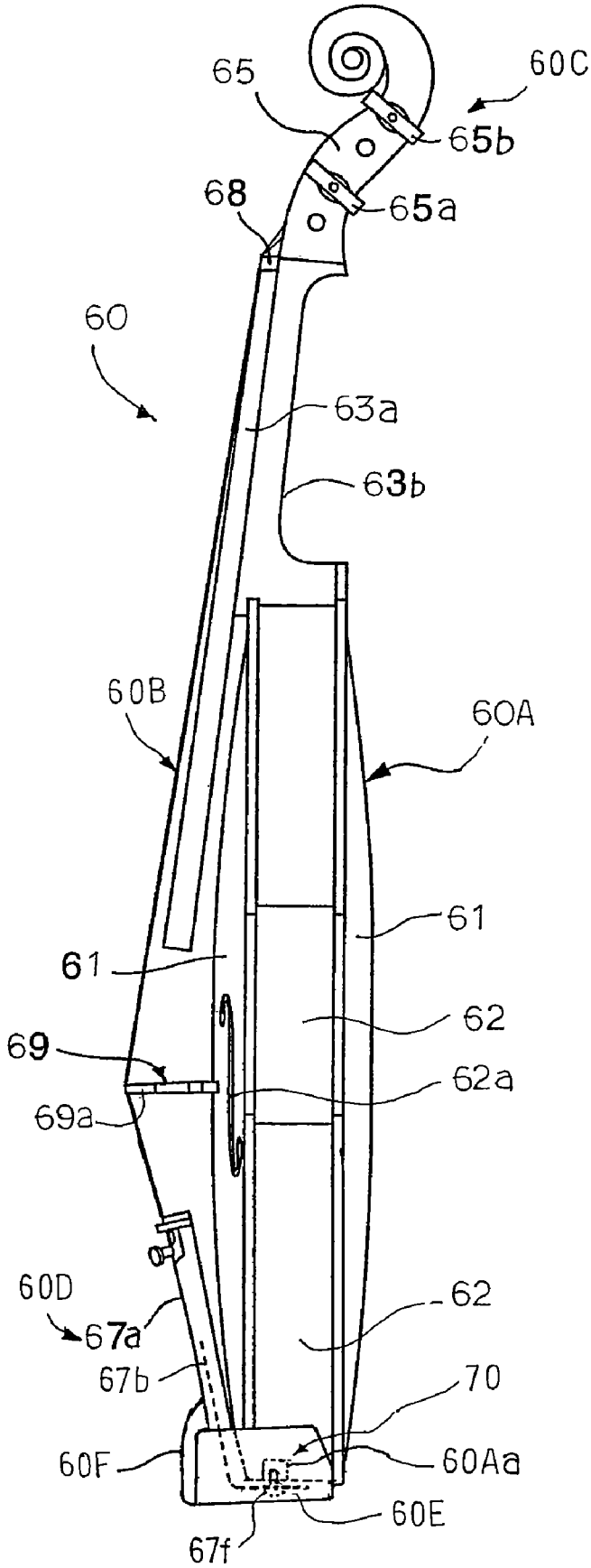
FIG. 13 is a side view showing the structure of the acoustic violin.

Turning to FIGS. 12 and 13 of the drawings, an acoustic violin embodying the present invention is designated in its entirety by reference numeral 60. The acoustic violin 60 largely comprises an instrument body 60A, a set of strings 60B, a stretcher 60C, an anchor 60D, a blindfold 60E and a chinrest 60F. The instrument body 60A is formed with a resonator, and the set of strings 60B is stretched over the instrument body 60A. The stretcher 60C and anchor 60D are fitted to both ends of instrument body 60A, and are spaced from each other in the longitudinal direction. The set of strings 60B is connected at one end thereof to the stretcher 60C and at the other end thereof to the anchor 60D. The stretcher 60C individually gives the tension to the strings of the set 60B so that a player can tune the acoustic violin 60 by regulating the strings of set 60B to appropriate tension. The chinrest 60F is fitted to the instrument body 60A, and the player puts his or her chin on the chinrest 60F during bowing on the set of strings 60B.

The blindfold 60E is supported by the chinrest 60F. The blindfold 60E does not extend over the connecting portion between the set of strings 60B and the anchor 60D, and permits users to see the connecting portion. However, the blindfold 60E extends the connecting portion between the anchor 60D and the instrument body 60A. For this reason, the blindfold 60E prohibits the connecting portion between the anchor 60D and the instrument body 60A from the eyes of users.

Figure 14:
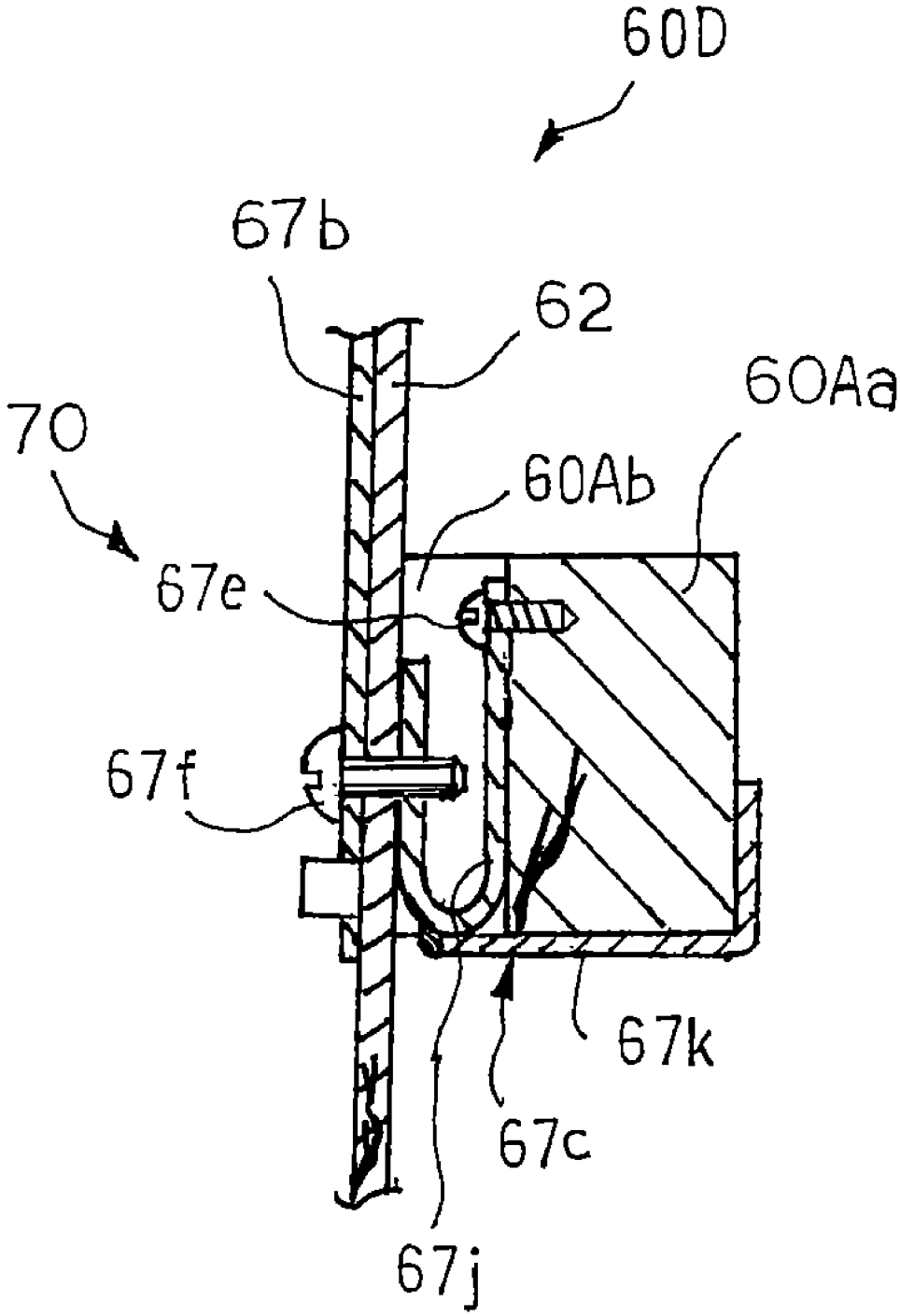
FIG. 14 is a cross sectional side view showing a fastener of the anchor of the present invention.

The instrument body 60A includes a set of soundboard 61, a rib 62, a finger board 63*a*, a neck 63*b*, a peg box 65 and a wood block 60Aa. The wood block 60Aa is illustrated in FIG. 14, and is provided inside the instrument body 60A. The soundboards 61 are constricted at intermediate portions thereof, and a pair of sound holes 62*a* is formed in one of the soundboards 61. The soundboards 61 are spaced from one another, and the rib 62 is adhered to the peripheries of soundboards 61. As a result, a hollow space, which serves as the resonator, takes place among the soundboards 61 and rib 62. The hollow space is open to the outside of instrument body 60A through the sound holes 62*a*. The wood block 60Aa is formed with a groove 60Ab, and is adhered to the inner surface of rib 62 in such a manner that the groove 60Ab is opposed to the inner surface of rib 62.

One of the soundboards 61 which is formed with the sound holes 62*a* offers an upper surface to other component parts, and the other of soundboards 61 has a lower surface. The sound holes 63*a* has a contour like alphabet letter "f", and are arranged in a mirror image with respect to the centerline of the instrument body 60A. The rib 62 has an outer surface serving as a side surface, a front end surface and a rear end surface of the instrument body 60A.

The neck 63*b* is adhered to the front end surface of instrument body 60A, and projects from the front end surface in the longitudinal direction. The finger board 63 has a rear portion and a front portion. The front portion of finger board 63*a* is laminated on the neck 63, and is adhered to the upper surface of neck 63*b*. The rear portion of finger board 63 extends over the upper surface of instrument body 60A, and reaches the space in the vicinity of sound holes 62*a*. The peg box 65 is adhered to a front end surface of the neck 63*b*.

The peg box 65 has a pair of side plates and a scroll. Four holes are formed in the pair of side plates in a staggered manner, and the scroll is formed in the front end of peg box 65 opposite to the finger board 63.

Four strings 64*a*, 64*b*, 64*c* and 64*d* form the set 60B, and are different in thickness from one another. While a player is bowing on the four strings 64*a*, 64*b*, 64*c* and 64*d* after the tuning work, the strings 64*a* to 64*d* vibrate, and the acoustic violin 60 produces tones, the compass of which is from the G below middle C, upwards for three and a half octaves and more.

The stretcher 60C includes four pegs 65*a*, 65*b*, 65*c* and 65*d*, a bridge 67 and a nut 68. The four holes of peg box 65 are respectively assigned to the four pegs 65*a*, 65*b*, 65*c* and 65*d*, and the four pegs 65*a* to 65*d* bridge the gap between the side plates of peg box 65. Although the pegs 65*a* to 65*d* are rotatable about the center axes of holes, the friction between the pegs 65*a* to 65*d* and the inner surfaces defining the holes are so large that the pegs 65*a* to 65*d* can keep themselves stable against the tension of strings 64*a* to 64*d*. The strings 64*a*, 64*b*, 64*c* and 64*d* have respective end portions, which are wound on the pegs 65*a*, 65*b*, 65*c* and 65*d*, respectively.

The nut 68 is adhered at the front end of neck 63*b* to the upper surface of neck 63*b*, and extends in the lateral direction. The bridge 69 stands on the upper surface of soundboard 61 between the sound holes 62*a*. The bridge 69 has a crown portion 69*a*, and the crown portion 69*a* has a gently curved upper surface. The strings 64*a* to 64*d* are held in contact with the upper surface of nut 68, and extend over the upper surface of finger board 63*a* toward the bridge 69. The strings 64*a* to 64*d* are in turn held in contact with the upper surface of crown portion 69*a*, and are terminated at the anchor 60D. body 60A. The distance between the upper surface of instrument body 60A and the upper surface of crown portion 69*a* is greater than the distance between the upper surface of instrument body 60A and the upper surface of finger board 63*a*, and, for this reason, the strings 64*a* to 64*d* are spaced from the upper surface of finger board 63*a*.

The anchor 60D has a tailpiece 67*a*, a tail wire 67*b* and a fastener 70. In this instance, the fastener 70 has a saddle unit 67*c* and bolts 67*d* and 67*e*. (See FIG. 14) The tail wire 67*b* is connected at one end thereof to the tailpiece 67*a*, and the other end of tail wire 67*b* is connected to the rib 62 by means of the saddle unit 67*c*. The tail wire 67*b* is curved, and keeps the tailpiece 67*a* spaced from the upper surface of instrument body 60A. For this reason, the tail wire 67*b* permits the tailpiece 67*a* freely to tremble during the bowing on the strings 64*a* to 64*d*. The player, who is used to bowing on the prior art acoustic violin 1, feels the bow on the strings 64*a* to 64*d* same as that on the strings 4*a* to 4*d*.

The saddle unit 67*c* has a curved plate 67*j*, which has a cross section like alphabet letter "J", and an angle bar 67*k*. The curved plate 67*j* and angle bar 67*k* are made of metal or alloy. The angle bar 67*k* is welded to the fold back portion of curved plate 67*j*, and extends in perpendicular to the long portion of the curved plate 67*j*. Bolt holes are formed in the long portion of curved plate 67*j*, and a threaded bolt hole is formed in the short portion of curved plate 67*j*. Since the bolt holes are not overlapped with the short portion, a worker can drive the bolts or screws 67*e* through the bolt holes into the wood block 60Aa with a suitable tool. The angle bar 67*k* is held in contact with the side surface and a back surface of wood block 60Aa, and keeps the long portion of curved plate 67*j* tightly held in contact with the wood block 60Aa.

A hole is formed in the rib 62 for an end pin. The bolt 67*f* is screwed through the hole into the threaded bolt hole of saddle unit 67*c*, and the tail wire 67*b* is pressed to the rib 62 by means of the bolt 67*f*. When a player wishes to change the tailpiece 67*a* to a more appropriate position, he or she looses the bolt 67*f*, and separates the tail wire 67*b* and tailpiece 67*a* from the instrument body 60A. The player changes the relative position between the tailpiece 67*a* and the tail wire 67*b*, and presses the tail wire 67*b* to the rib 62 by means of the bolt 67*f* and saddle unit 67*c*, again. Thus, the player can regulate the distance between the bridge 69 and the tailpiece 67*a*.

The blindfold 60E is implemented by an extension of the chinrest 60F. For this reason, the blindfold 60E and chinrest 60F have a unitary structure in this instance. The extension of chinrest 60F extends over the upper surface of instrument body 60A in such a manner that the rear portion of tailpiece 67*a* is covered with the extension of chinrest 60F. Moreover, the extension of chinrest 60F is bent along the instrument body 60A, and extends over the rib 62. Since the rib 62 is curbed, the extension of chinrest 60F is also curved. As a result, the rear portion of tailpiece 67*a*, tail wire 67*b* and bolt 67*f* are covered with the blindfold 60E. Thus, the blindfold 67E prevents the rear portion of tailpiece 67*a*, tail wire 67*b* and bolt 67*f* from eyes of users.

As will be understood from the foregoing description, the tail wire 67*b* keeps the tailpiece 67*a* float over the upper surface of instrument body 60A so that the player feels the bow on the strings 64*a* to 64*d* same as that on the strings 4*a* to 4*d* of prior art acoustic violin 1.

The metal bolt 67*f* is held in threaded engagement with the metal saddle unit 67*c* so that the anchor 60D is free from the aged deterioration and change in temperature and humidity.

Moreover, the blindfold 60E prevents the tail wire 67*b* and bolt 67*f* from eyes of users so that the users feel the acoustic violin 60 neat.

Fourth Embodiment

Figure 15:
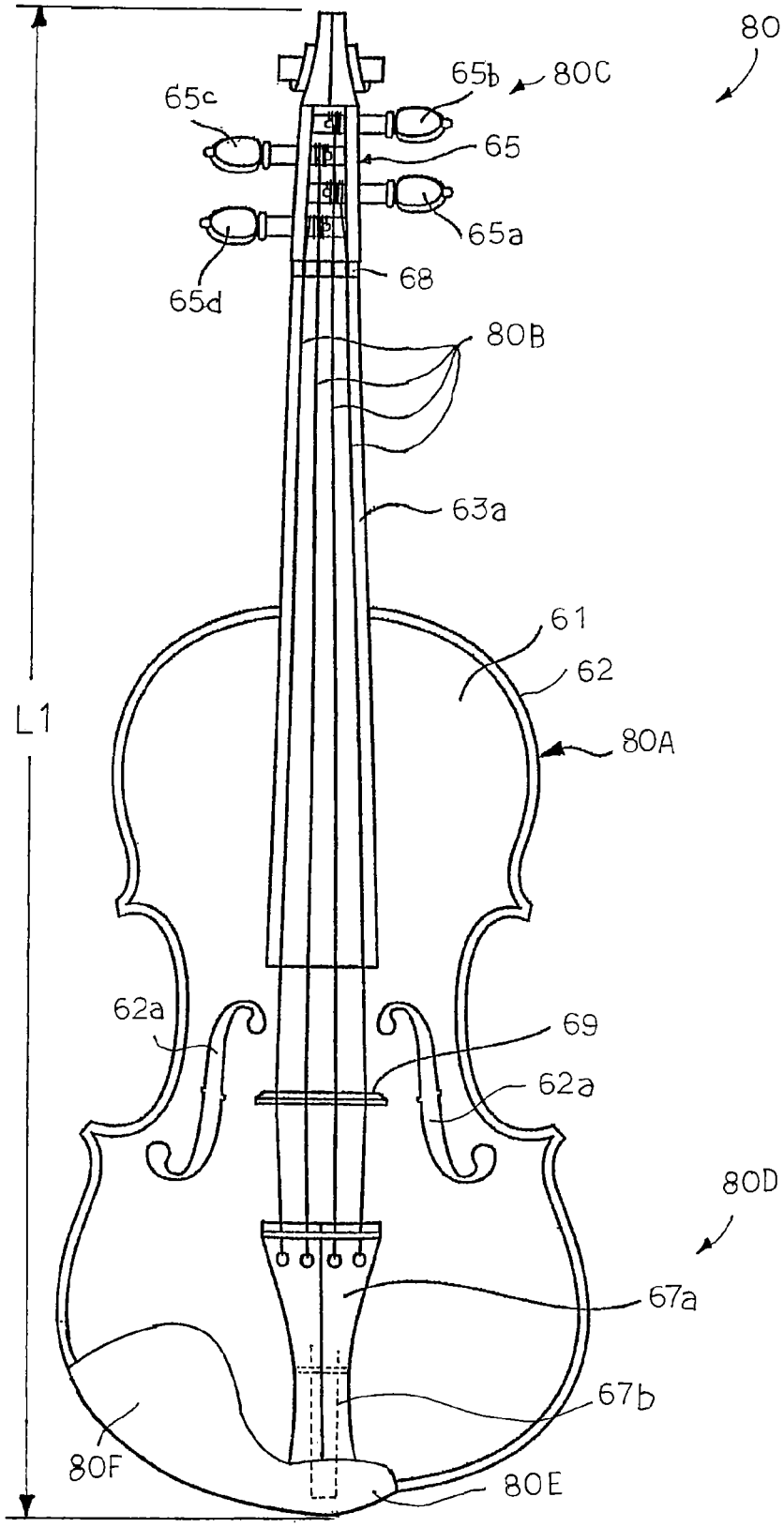
FIG. 15 is a plane view showing the structure of an acoustic viola of the present invention.

Turning to FIG. 15 of the drawings, an acoustic viola embodying the present invention is designated in its entirety by reference numeral 80. The acoustic viola 80 largely comprises an instrument body 80A, a set of strings 80B, a stretcher 80C, an anchor 80D, a blindfold 80E and a chinrest 80F.

The instrument body 80A is made of wood, and is formed with a resonator as similar to the acoustic violin 60. The acoustic viola 80 is different in size from the acoustic violin 60. For example, the instrument body 80A has length L1 greater than the length of acoustic violin 60. However, component parts of the instrument body 80A are similar to those of the instrument body 60A. For this reason, the component parts of instrument body 80A are labeled with the references designating the corresponding component parts of instrument body 60A without detailed description.

The strings 80B are vibratory during bowing, and the tones are produced through the vibrations of strings 80B. The compass of strings 80B is from the C below middle C, upward for more than three octaves.

The stretcher 80C, anchor 80D, blindfold 80E and chinrest 80F are similar to those of the acoustic violin 60, and have component parts corresponding to those of the acoustic violin 60. For this reason, the components parts of acoustic viola 80 are labeled with references designating the corresponding component parts of acoustic violin 60.

The anchor 80D makes a player feel a bow on the strings 80B same as that on the strings of a standard acoustic viola, and the blindfold 80E prevents the tail wire 67B and fastener from the eyes of users. The users do not have any antique impression on the anchor 90D. The acoustic viola 80 achieves all the advantages of electric violin 40.

Fifth Embodiment

Figure 16:
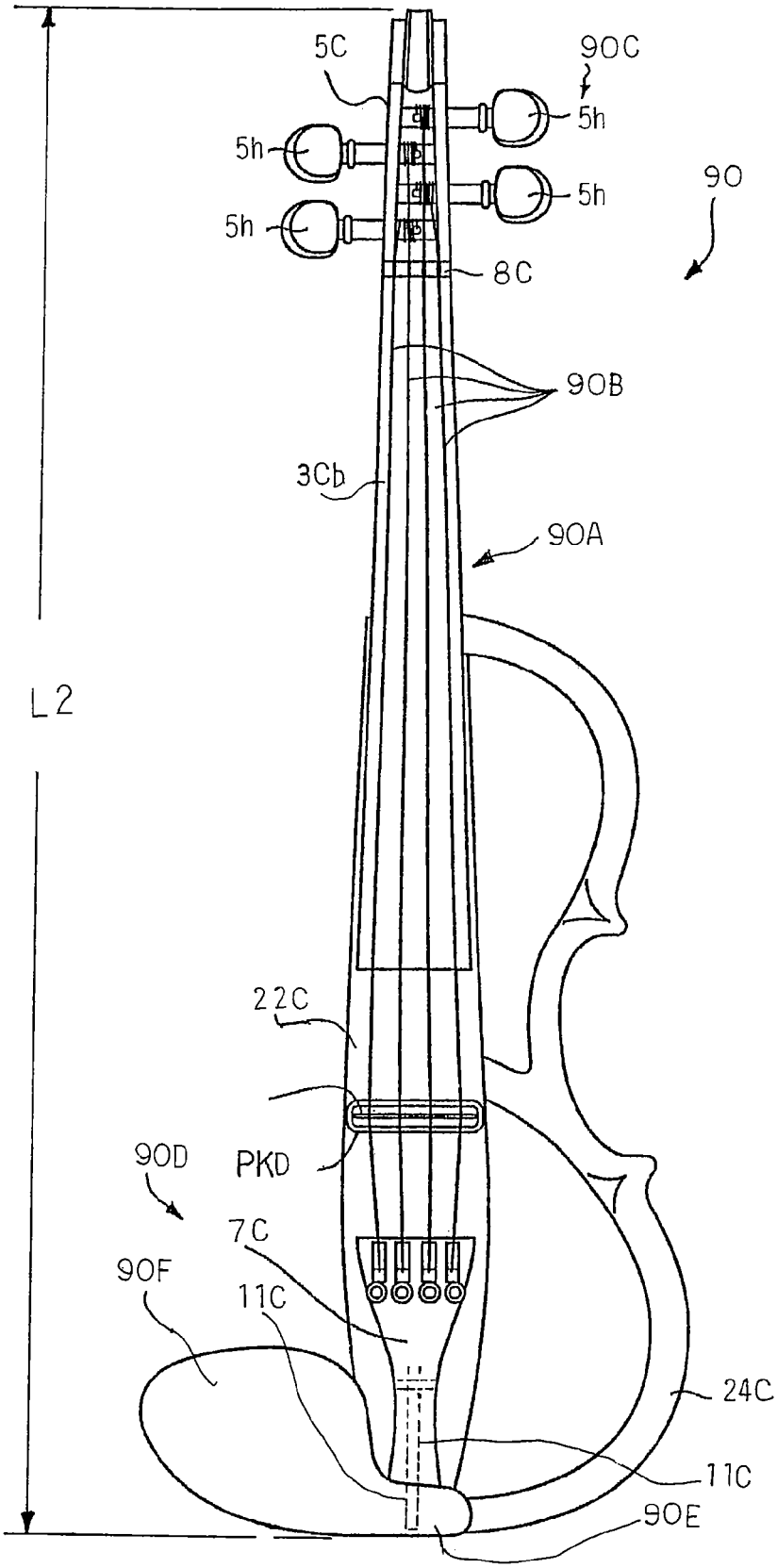
FIG. 16 is a plane view showing the structure of an electric viola of the present invention.

Turning to FIG. 16 of the drawings, an electric viola embodying the present invention is designated in its entirety by reference numeral 90. The electric viola 90 largely comprises an instrument body 90A, a set of strings 90B, a stretcher 90C, an anchor 90D, a blindfold 90E, a chinrest 90F and a pickup PKD.

The instrument body 90A does not have any resonator. The electric viola 90 is different in size from the electric violin 40. For example, the instrument body 90A has length L2 greater than the length of electric violin 40. However, component parts of the instrument body 90A, component parts of stretcher 90C and component parts of anchor 90D are similar to those of the electric violin 40. For this reason, the component parts of electric viola 90 are labeled with the references designating the corresponding component parts of electric violin 40 without detailed description.

The anchor 90D makes a player feel a bow on the strings 90B same as that on the strings 80B of acoustic viola, and the blindfold 90E prevents the tail wire 11C and fastener from the eyes of users. The users do not have any antique impression on the anchor 90D. Thus, the electric viola 90 achieves all the advantages of acoustic violin 60.

Although particular embodiments of the present invention have been shown and described, it will be apparent to those skilled in the art that various changes and modifications may be made without departing from the spirit and scope of the present invention.

The blindfold 40E may be implemented by a curved plate independent of the chinrest 12C and side frame 24C.

The saddle plate 42 and bolts 41 and 43 do not set any limit to the technical scope of the present invention. A metal toggle joint may be secured to the rear portion of center stem so as to make it possible to anchor the tail wire to the rear portion of center stem. A suitable lock may be further provided for the lever of toggle joint. A quick disconnect coupling is another example of the fastener available for the stringed musical instrument of the present invention.

The tail wire may be called as a "tail gut".

The blindfold of the present invention may appertain to an acoustic cello, an electric cello, an acoustic contrabass and an electric contrabass.

The saddle plate may be made of synthetic resin in so far as the synthetic resin is less influenced in variation of humidity and durable rather than wood. Carbon fiber may be used for the saddle plate.

The acoustic violin and acoustic viola of the present invention may be equipped with a sound-to-electric signal converter inside the instrument body.

The component parts of stringed musical instruments 40, 50, 60, 80 and 90 are correlated with claim languages as follows. The electric violins 40 and 50, acoustic violin 60, acoustic viola 80 and electric viola 90 serve as a "stringed musical instrument". The instrument body 40A, 50A, 60A, 80A and 90A are corresponding to an "instrument body", and any one of the strings 4C, 64*a* to 64*d*, 80B and 90B is corresponding to "at least one string". Any one of the pegs 5*h* and 65*a* to 65*d* serves as a "connector". Any one of the tailpieces 7C, 7E or 67*a* is corresponding to a "tailpiece", and any one of the tail wires 11C, 11E and 67*b* is corresponding to a "tail wire". The fastener 10C, i.e., the combination of saddle plate 42 and bolts 41 and 43 serves as a "fastener". The fastener 10E or 70 also serves as the "fastener". Any one of the blindfolds 40Ea, 60E, 80E and 90E serves as "a blindfold".

The soundboards 61 and rib 62 are corresponding to "plural plates". The bolts 43 serve as "at least one wood screw". The upper surface and lower surface of the center stem 22C are corresponding to "a major surface" and "another major surface". The center stem 22C serves as a "wood piece", and the wood block 60Aa also serves as the "wood piece".

What is claimed is:

1. A stringed musical instrument for producing music sound comprising:

an instrument body having a longitudinal direction and a lateral direction;

at least one string stretched in said longitudinal direction over said instrument body;

a connector connected between one end of said instrument body and one end of said at least one string; and a tailpiece unit provided at the other end of said instrument body, and including a tailpiece connected to the other end of said at least one string, a tail wire connected at one end thereof to said tailpiece and keeping said tailpiece spaced from said instrument body, a fastener made of a certain sort of material less influenced in variation of humidity rather than wood and securing said tail wire to said instrument body, and a blindfold supported by said instrument body and preventing said tail wire and said fastener from eyes of users.

2. The stringed musical instrument as set forth in claim 1, in which said instrument body has a center stem without a hollow space serving as a resonator and a framework connected to said center stem.

3. The stringed musical instrument as set forth in claim 2, further comprising a vibration-to-electric signal converter so as to convert vibrations of said at least one string to an electric signal.

4. The stringed musical instrument as set forth in claim 2, in which said electric signal is converted to electric tones fallen within a compass same as the compass of an acoustic violin.

5. The stringed musical instrument as set forth in claim 2, in which said electric signal is converted to electric tones fallen within a compass same as the compass of an acoustic viola.

6. The stringed musical instrument as set forth in claim 1, in which said instrument body has plural plates defining a hollow space serving as a resonator for enlarging loudness of tones produced through vibrations of said at least one string.

7. The stringed musical instrument as set forth in claim 6, in which said at least one string and other strings produces acoustic tones fallen within a compass same as an acoustic violin.

8. The stringed musical instrument as set forth in claim 6, in which said at least one string and other strings produces acoustic tones fallen within a compass same as an acoustic viola.

9. The stringed musical instrument as set forth in claim 1, further comprising a chinrest supported by said instrument body, and said chinrest and said blindfold have a unitary structure.

10. The stringed musical instrument as set forth in claim 1, in which said instrument body has a center stem made of wood, and said fastener includes a saddle plate made of said certain sorts of material and formed with at least one hole and at least one threaded hole, at least one wood screw driven into said center stem for pressing said saddle plate to said center stem and at least one bolt driven into said at least one threaded hole for pressing said tail wire to said saddle plate.

11. The stringed musical instrument as set forth in claim 10, in which said tailpiece is provided over a major surface of said center stem, and said tail wire extends from said tailpiece through an end surface of said center stem to another major surface of said center stem, wherein said saddle plate is pressed to said another major surface by means of said at least one wood screw.

12. The stringed musical instrument as set forth in claim 11, in which said blindfold extends from a space over an area of said major surface where said tail wire extends through over said end surface to a space over an area of said another major surface where said saddle plate is pressed.

13. The stringed musical instrument as set forth in claim 1, in which said instrument body has a center stem made of wood, and said fastener includes at least one wood screw driving into said center stem for pressing said tail wire to said center stem.

14. The stringed musical instrument as set forth in claim 1, in which a player rubs said at least one string with a bow so as to give rise to vibrations of said at least one string.

15. A tailpiece unit used for a stringed musical instrument, comprising:

a tailpiece connected to an end of at least one string of said stringed musical instrument;

a tail wire connected at one end thereof to said tailpiece, and keeping said tailpiece spaced from an instrument body of said stringed musical instrument;

a fastener made of a certain sort of material less influenced in variation of humidity rather than wood, and securing said tail wire to said instrument body; and a blindfold supported by said instrument body, and preventing said tail wire and said fastener from eyes of users.

16. The tailpiece unit as set forth in claim 15, in which said fastener includes a saddle plate made of said certain sorts of material and formed with at least one hole and at least one threaded hole, at least one wood screw driven into a wood piece of said instrument body for pressing said saddle plate to said wood piece and at least one bolt driven into said at least one threaded hole for pressing said tail wire to said saddle plate.

17. The tailpiece unit as set forth in claim 16, in which said tailpiece is provided over a major surface of said wood piece, and said tail wire extends from said tailpiece through an end surface of said wood piece to another major surface of said wood piece, wherein said saddle plate is pressed to said another major surface by means of said at least one wood screw.

18. The tailpiece unit as set forth in claim 17, in which said blindfold extends from a space over an area of said major surface where said tail wire extends through over said end surface to a space over an area of said another major surface where said saddle plate is pressed.

19. The tailpiece unit as set forth in claim 15, in which said fastener includes at lest one wood screw driving into a wood piece of said instrument body for pressing said tail wire to said wood piece.

20. The tailpiece unit as set forth in claim 15, in which said blindfold is an extension of a chinrest supported by said instrument body.

* * * * *